US005400891A

United States Patent [19]

Winstanley

[11] Patent Number: 5,400,891

[45] Date of Patent: Mar. 28, 1995

[54] COIN TESTING MECHANISM

[75] Inventor: Nigel A. Winstanley, Reading, Great Britain

[73] Assignee: Mars Incorporated, McLean, Va.

[21] Appl. No.: 988,105

[22] PCT Filed: Jul. 18, 1991

[86] PCT No.: PCT/GB91/01204

§ 371 Date: Feb. 8, 1993

§ 102(e) Date: Feb. 8, 1993

[87] PCT Pub. No.: WO92/02902

PCT Pub. Date: Feb. 20, 1992

[30] Foreign Application Priority Data

Aug. 10, 1990 [GB] United Kingdom ..... 9017565

[51] Int. Cl.[6] ..... G07F 9/10; G07F 3/02; G07F 3/04

[52] U.S. Cl. ..... 194/350; 73/163

[58] Field of Search ..... 73/163; 206/0.81, 0.84; 194/350; 453/5, 9, 14, 15

[56] References Cited

U.S. PATENT DOCUMENTS

| | | | |
|---|---|---|---|
| 3,590,833 | 7/1971 | Walton | 453/9 |
| 4,326,550 | 4/1982 | Mochizuki et al. . | |
| 4,607,650 | 8/1986 | Kobayashi et al. . | |

FOREIGN PATENT DOCUMENTS

| | | | |
|---|---|---|---|
| 0808991 | 3/1969 | Canada | 453/5 |
| 1317326 | 1/1963 | France | 453/9 |
| 1331794 | 5/1963 | France . | |
| 2455772 | 8/1976 | Germany . | |
| 60-8996 | 1/1985 | Japan . | |
| 1015434 | 12/1965 | United Kingdom . | |
| 2027967 | 2/1980 | United Kingdom . | |
| 2065950 | 7/1981 | United Kingdom . | |
| 2118345 | 10/1983 | United Kingdom . | |
| 2140187 | 11/1984 | United Kingdom | 73/163 |
| 2179030 | 2/1987 | United Kingdom . | |

*Primary Examiner*—Diego F. F. Gutierrez
*Attorney, Agent, or Firm*—Davis Hoxie Faithfull & Hapgood

[57] ABSTRACT

A coin testing mechanism of the kind provided with a removable and replaceable cassette is described. The coin testing mechanism includes a plurality of coin storage tubes and means for dispensing coins from the storage tubes, and the removable cassette is an assembly which comprises a plurality of storage tube modules. Each of the modules comprises at least one storage tube, and the modules are retained in the assembly by releasable and reusable retaining means to enable exchanging one module of the cassette for another.

8 Claims, 2 Drawing Sheets

COIN TESTING MECHANISM

FIELD OF THE INVENTION

This invention relates to coin testing mechanisms and in particular coin testing mechanisms of the kind provided with a removable and replaceable cassette which includes a plurality of coin storage tubes, and means for dispensing coins from the storage tubes. Such dispensing is required for the purpose of paying out change or giving prizes.

BACKGROUND OF THE INVENTION

There are many published patent applications and granted patents which describe and show coin mechanisms in which such cassettes are used, and large numbers of coin mechanisms incorporating such cassettes have been manufactured and sold.

It has been the common practice for the coin storage tubes of the cassette to all be formed in a single injection-moulded part, in plastics material, or for the cassette to be assembled from two parts each of which is injection moulded in plastics material, one of the parts including the fronts of all the coin tubes and other of the parts including their backs, so that each coin tube is effectively constructed from two parts, a front and a back.

For the purpose of this specification the term "coin storage tube" is intended to encompass any structure capable of holding coins in a stable stack one above the other face-to-face, irrespective of whether or not it completely surrounds the stack and irrespective of whether or not it is of a generally circular cross-section.

SUMMARY OF THE INVENTION

One object of the present invention is to provide coin mechanisms in which a cassette including coin tubes is used, but in which the adaptability of the cassette is improved and the cost of manufacturing cassettes for storing different combinations of coins is reduced.

The invention provides a coin testing mechanism of the kind provided with a removable and replaceable cassette which includes a plurality of coin storage tubes, and means for dispensing coins from the storage tubes, characterised in that the cassette is an assembly which comprises a plurality of storage tube modules each of which modules comprises at least one storage tube, the modules being retained in the assembly by releasable and re-usable retaining means whereby to enable exchanging of one module of the cassette for another.

In a first aspect, the cassette assembly is so arranged that no module can be removed from the cassette assembly until the cassette assembly has been removed from a main frame of the coin mechanism. In a second aspect, in addition to the retaining means, a locking means is provided for locking the modules in position. In a third aspect the retaining means a push or snap fittings operable by hand to retain and release each module.

The invention facilitates modifying an existing coin mechanism so that it can store a different set of coin denominations from previously, and also modifying an existing coin mechanism so that it can store a newly introduced size of coin, even though the denomination of that coin may be the same as the previously used but differently sized coin of that denomination. It will be understood, of course, that the coins of the world vary very greatly in diameter and although a single coin tube internal diameter may be usable for coins of a range of different diameters, nevertheless a selection of coin tubes having different internal diameters will be required in order for an appropriate internal diameter for each of the commonly used coins, or at least most of them, to always be available.

By the use of the invention, a coin tube already in the cassette can readily be removed therefrom after the cassette has been detached from its coin mechanism and a tube of a different diameter can be easily installed in its place.

Previously known coin tube cassettes would have required replacement of the entire cassette in order for the coin mechanism to be comparably adapted for storing a different set of coins.

At the manufacturing stage, previous coin tube cassettes would have required separate, and relatively expensive, tooling for each particular combination of tube internal diameters to be incorporated into a cassette.

The invention enables the manufacture of cassettes having various different combinations of internal tube diameters, by manufacturing on relatively simple and inexpensive tooling tubes having a limited number of different internal diameters, perhaps six or seven, and then assembling these into cassettes using the releasable and re-usable retaining means, in whatever combinations may be required for the particular coin mechanisms being manufactured.

BRIEF DESCRIPTION OF THE DRAWINGS

In order that the invention may be more clearly understood, an embodiment thereof will now be described, by way of example, with reference to the accompanying diagrammatic drawings in which.

DETAILED DESCRIPTION OF THE INVENTION

Figure 1:
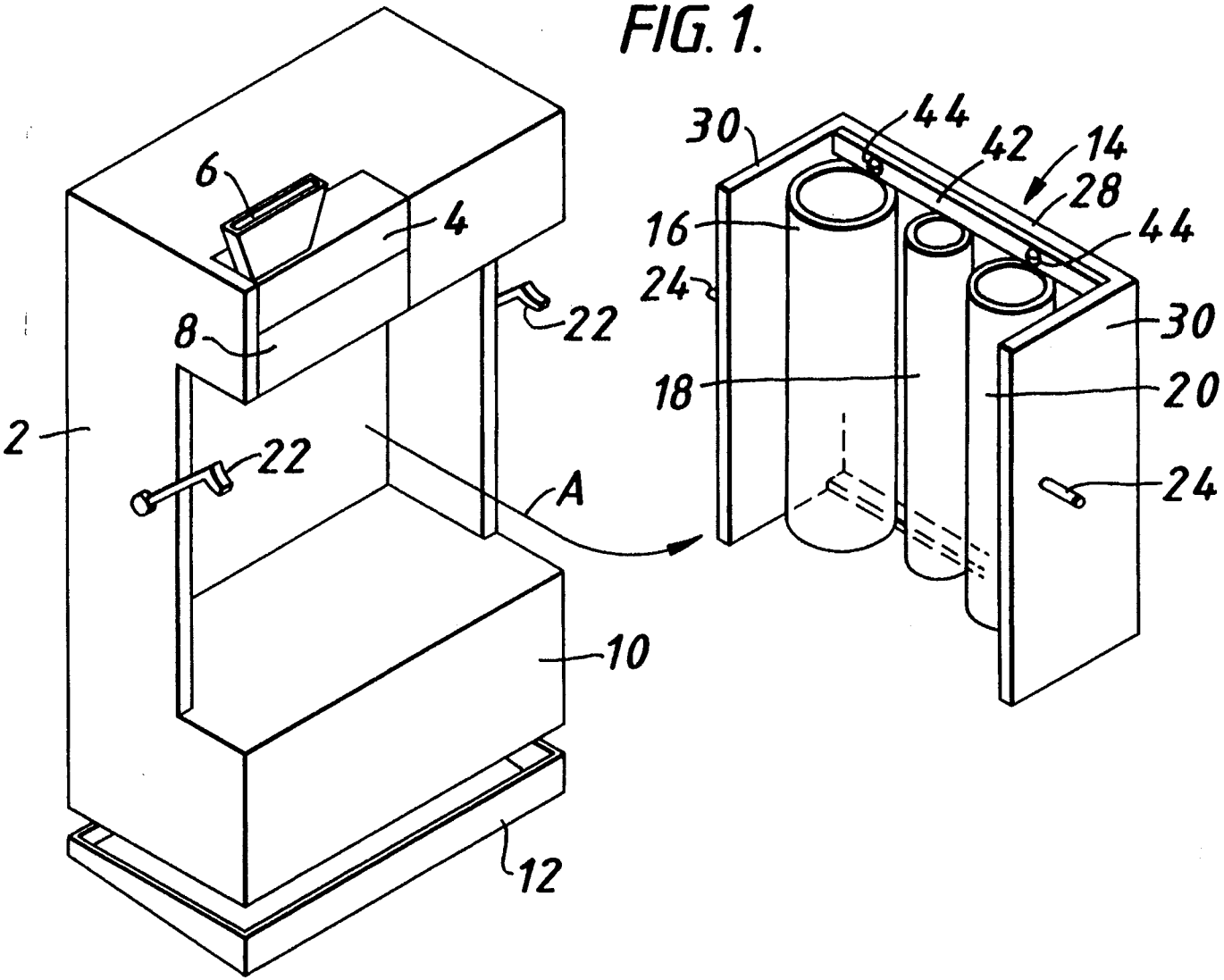
FIG. 1 shows a coin testing mechanism in accordance with the invention with its coin tube cassette removed.

In many respects the coin testing mechanism shown in FIG. 1 is conventional. It includes a mainframe 2 into which are fitted a coin tester or validator 4 having a coin inlet 6. In conventional manner the coin tester 4 tests coins to determine whether they meet acceptability criteria for the particular mechanism. If not, it rejects them for retrieval by the user. Acceptable coins pass to a coin separator 8 which routes them, according to their denomination as determined by the testing section 4, to respective coin storage tubes each of which is for receiving one particularly denomination, or alternatively to a cashbox if the proper coin storage tube is full or if the coin denomination involved is not one which is intended to be dispensed.

A coin dispensing section 10 is located below the coin tubes and may be of conventional kind, being operable to dispense coins one-by-one from the bottom ends of the respective coin tubes in whatever combinations may be appropriate for giving change or prizes, the dispensed coins falling into a tray 12 beneath the mechanism for collection by the user.

A cassette is shown generally at 14, which includes three coin storage modules 16, 18 and 20 (though in practice four tubes would often be present, or perhaps more). Each module 16, 18, 20 shown in FIG. 1 comprises a single coin tube. The modules 16, 18 or 20 can comprise two or more coin storage tubes attached to each other, as well. In its operative position, the cassette fits into the recess at the front of the coin testing mechanism as illustrated in FIG. 1, where it is held by hand-operable fastening means such as the pivotable hooks 22 which can be engaged over pegs 24 located on either side of the cassette. This enables easy removal of the cassette from the mechanism as illustrated by the arrow A and also easy replacement of the cassette in the mechanism.

The three coin tubes may all be substantially the same, apart from their diameters, though of course it will not normally be necessary for every coin tube in a mechanism to be different from that of all the other coin tubes.

Figure 2:
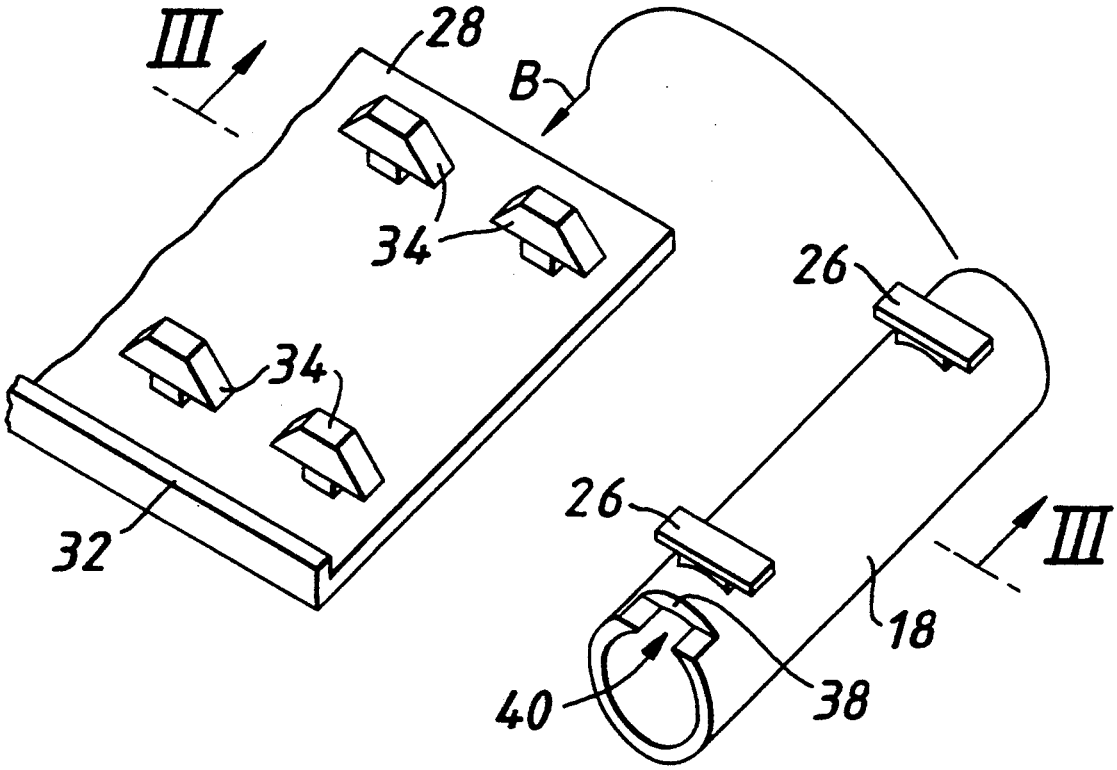
FIG. 2 illustrates a part of the cassette and shows in particular the releasable and re-usable retaining means for retaining a coin tube in the cassette.
Figure 3:
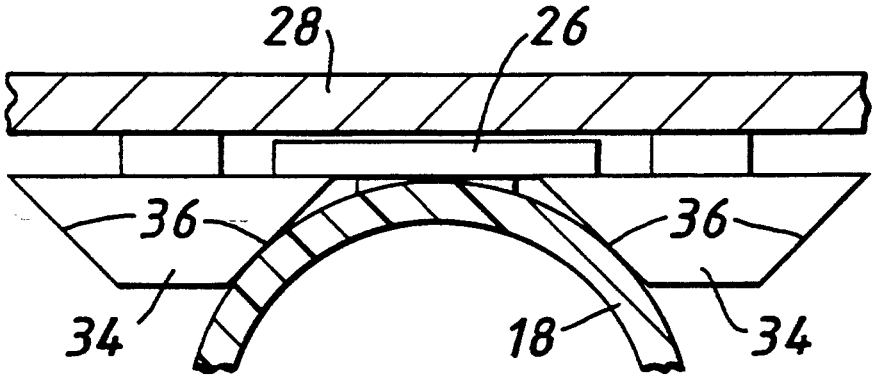
FIG. 3 shows a cross-section through FIG. 2, taken in the direction III—III, when the coin tube has been assembled into position.

FIG. 2 and FIG. 3 show, just by way of example, the coin tube IS which may be injection moulded in a single piece from plastics material with two pars 26 molded integrally with it, the bars extending transversely of the tube and being located respectively near to its upper and its lower ends.

The cassette 14 includes a generally channel-shaped tube support having a front wall 28 and two side walls 30. It also has an abutment in the form of a narrow shelf 32 extending across the lower edge of the front wall 28. On the inside of the front wall 28 are pairs of T-shaped projections 34. The tube support may be manufactured as a single part by injection moulding from plastics material.

To assemble tube 18 to the tube support, it is turned from the position shown in FIG. 2 and the bars 26 are placed against the inside of the front wall 28 between and above the respective pairs of projections 34 (i.e., above and to the right of them in the orientation shown in FIG. 2). The tube 18 is then pushed in the direction of the arrowhead B so that the opposed ends of the bars 26 enter under opposed arms of respective pairs of projections 34 as shown in FIG. 3, while the chamfered ends of the arms of the projections 34, indicated at 26 in FIG. 3, contact the curved outer wall of tube 18.

The components are dimensioned so that the retaining means are an interference fit and some manual force is required to push the tube 18 in the direction of arrow B. Its movement in this direction is limited by an edge 38 of an arcuate cut-out 40 of the lower end of tube 18 contacting the upper surface of the abutment 32.

The depth of the cut-out 40, in the axial direction of the tube, may be made such that when the tube has been fully pushed into contact with the abutment 32 its lower edge is a predetermined distance below the bottom edge of that abutment and consequently is in a predetermined position relative to the dispensing section 10 when the cassette is installed into the coin testing mechanism. This may be important for the correct operation of the dispensing section, depending upon its exact design, as is well known.

The tubes 16 and 20 can be retained in basically the same way as tube 18. Bars 26 on them can engage under the outwardly facing arms of the T-shaped projections 34, and also under the arms of similar additional projections (not shown) also formed on the inner face of the front wall 28 relatively near to the side walls 30 so that the other ends of the bars 26 on tubes 16 and 20 are similarly engaged.

It should be appreciated that various forms of snap-fitting could be utilised in place of the push-fitting retaining means 26, 34 which have been illustrated. It is preferable for the retaining means not to require the use of tools for the purpose of releasing and replacing the coin tubes so that this can be done most quickly and efficiently by an operator when the coin mechanism is out in the field, and so that the cassette can be most efficiently assembled where it is being manufactured.

If desired, locking means may also be provided for locking the coin tubes into position. In FIG. 1 such locking means is shown in the form of a bar 42 secured across and in contact with the upper edges of tubes 16, 18 and 20 by means of two screws 44 which are screwed into the front wall 28. For additional simplicity in removing and replacing the tubes, the screws 44 could be replaced by any suitable design of finger-operable fastener.

Although in the embodiment described each individual coin tube is formed separately, it is possible that in practice a particular combination of two specific coin tube diameters may be required, adjacent to each other, sufficiently often that it is economic to manufacture those two particular tube sizes as a single part, thus forming a module which includes two tubes. The term "storage tube module" is used in the accompanying claims to encompass a component of this sort which includes more than just one coin storage tube.

I claim:

1. A coin testing mechanism comprising a main frame; a coin validator supported by the main frame and having a coin inlet for receiving coins; a coin separator supported by the main frame and connected to the coin validator to receive a coin from the coin validator; a cassette, removable and replaceable from the main frame, the cassette comprising a plurality of coin storage modules, each module comprising at least one coin storage tube, the separator routing coins to a selected one of the plurality of coin storage tubes; and means for dispensing coins from the storage tubes; each of the modules being retained in the cassette by releasable and reusable retaining means to enable exchanging of one module of the cassette for another, the modules being arranged and retained in the cassette such that no module can be removed from the cassette until the cassette has been removed from said main frame.

2. A coin testing mechanism as claimed in claim 1, wherein the retaining means comprises first fittings provided axially along each said tube and engageable with aligned second fittings provided on said cassette, and being operable by hand to retain and release each module by moving each module axially to bring said first fittings into and out of alignment with said second fittings.

3. A coin testing mechanism as claimed in claim 1 wherein the cassette comprises a tube support and the retaining means secure the tube modules to the tube support.

4. A coin testing mechanism as claimed in claim 3 wherein the tube support includes abutment means for providing a defined limit upon downward movement of the tube modules when the tube modules are in an upright operating position.

5. A coin testing mechanism as claimed in claim 1 wherein the retaining means for each module are independent of each other, whereby each module can be removed from the cassette independently of the others.

6. A coin testing mechanism as claimed in claim 1 further comprising fastening means operable by hand to enable removal of the cassette from, and its replacement in, the main frame.

7. A coin testing mechanism as claimed in claim 1, further comprising locking means for locking the modules to the cassette.

8. A coin testing mechanism as claimed in claim 7, wherein the locking means comprises a single locking member and fastening means for fastening said member in a blocking position in which it simultaneously blocks the removal of all of said modules.

* * * * *